US008099917B2

(12) United States Patent
Stein

(10) Patent No.: US 8,099,917 B2
(45) Date of Patent: Jan. 24, 2012

(54) METAL "LOGS" BUILDINGS WITH RIGIDIFYING INTERIOR AND EXTERIOR SHEATHING

(76) Inventor: Alejandro Stein, Crans-Pres-Celigny (CH)

( * ) Notice: Subject to any disclaimer, the term of this patent is extended or adjusted under 35 U.S.C. 154(b) by 678 days.

(21) Appl. No.: 12/157,051

(22) Filed: Jun. 6, 2008

(65) Prior Publication Data

US 2009/0301012 A1 Dec. 10, 2009

(51) Int. Cl.
*E04B 1/10* (2006.01)

(52) U.S. Cl. ..... 52/233; 52/235

(58) Field of Classification Search ..... 52/233, 52/235, 236.2

See application file for complete search history.

(56) References Cited

U.S. PATENT DOCUMENTS 2,296,781 A * 9/1942 Farny ..... 156/188
4,619,089 A 10/1986 Stein
5,282,343 A 2/1994 Stein

FOREIGN PATENT DOCUMENTS

CA 2584561 A1 12/2007

* cited by examiner

*Primary Examiner* — Basil Katcheves
(74) *Attorney, Agent, or Firm* — Donald S. Dowden

(57) ABSTRACT

A U-shaped rigidifying member cooperates with parallel metal "logs" each usually extending horizontally. A curved portion of the U wraps halfway around a first log, and first and second legs respectively descend in parallel from opposite sides of the curved portion. The legs are substantially tangent to a second log. This structure is repeated with the U-shaped members overlapping and inverted or otherwise oriented to shed rain, and forms all or part of a wall or sloping roof of a building. The U-shaped members are secured to each other and to the logs to form a continuous structural ensemble that is aesthetically pleasing, even without additional interior and exterior sheathing. It is moreover strong and highly resistant to an external force having a horizontal component parallel to the plane of the wall or roof. The rigidifying members can alternatively be J-shaped.

15 Claims, 10 Drawing Sheets

METAL "LOGS" BUILDINGS WITH RIGIDIFYING INTERIOR AND EXTERIOR SHEATHING

BACKGROUND OF THE INVENTION

1. Field of the Invention

This invention relates to log buildings and more particularly to a novel and highly effective combination of elements that improves the rigidity and other properties of such buildings, especially those made of hollow metal "logs," while reducing their cost.

2. Description of the Prior Art

Log buildings have a long history. They were common in North America during its early settlement by Europeans, especially in areas where trees were plentiful—which is to say much of the continent. Abraham Lincoln and other notables at times made their homes in log cabins. The logs of those residences were traditional: that is, made of solid wood, which, though slightly less dense than water, is quite heavy, making the logs difficult to handle. (In parts of Asia, even today, elephants are sometimes employed to move wooden logs.)

In much of the world, wood in commercial quantities is not locally available and must be imported, often from a considerable distance and always at a considerable cost. Despite their cost, wood logs are occasionally used today to build houses, storage sheds, and low-rise apartments, schools, lodges, offices, and other commercial and industrial structures. Usually, however, wooden structures today are not made of logs but are framed with sills, joists, studs, rafters, and ridgepoles and finished with interior and exterior sheathing.

Experts predict that hollow metal structures called logs by analogy to traditional wooden logs may soon be preferred in much of the world for low-rise construction of all types. They have some undeniable advantages over wooden-log and wood-frame construction:

- they are resistant to damage by fire and termites, in contrast to wooden structures;
- aluminum, galvanized steel, or other metal or plastic material for forming the logs can be delivered to the building site in form of coils, with huge savings in shipping costs;
- using inexpensive machinery that can be moved from site to site, unskilled labor can form the strip material into lightweight hollow "logs" and have them cut to the required length at the site, with no waste;
- unskilled labor can easily position the logs by hand and employ inexpensive preformed end connectors to connect the logs in precise alignment;
- the hollow logs, because of the air they enclose, have inherent insulating properties, even if made of heat-conducting material such as aluminum or steel;
- the time required for construction, from beginning to end, is but a fraction of the time required by traditional building methods, thereby reducing financing costs and making new construction quickly available on demand.

This document incorporates by reference the disclosures in the present applicant's prior U.S. Pat. Nos. 4,619,089 and 5,282,343. Those patents and corresponding patents in other countries disclose the best prior examples of metal log construction. Buildings following their teachings have been erected in many parts of the world and have found wide and growing acceptance. They are suitable for all markets in view of their properties noted above plus their ready compliance with building codes, their speed and simplicity of construction, their safety and comfort, as well as their flexible floor plans. Government authorities and private builders in various countries have erected them because of the speed with which they can replace buildings that are substandard or have been damaged or destroyed by fire, flood, earthquake, etc.

A wall or sloping roof section typically has of course the shape of a rectangle (rectangular parallelogram). But parallelograms, whether rectangular or not, lack the rigidity of triangles, and do not strongly resist forces tending to move diagonally opposite corners closer to or farther from each other.

In conventional metal log construction of, say, a rectangular wall, hollow metal logs each extending usually horizontally (but sometimes vertically) are arranged in adjacent, parallel, and, if extending horizontally, superposed relation. The logs are supported at their ends, typically though not necessarily in slightly spaced-apart relation, by end connectors each having a connecting portion inserted into a log and a stackable portion.

The stackable portions are simply stacked one above another. Alternatively, the logs, which can be circular or oval in cross section or have another suitable shape, can be stacked in vertical retaining grooves formed in stanchions, as shown for example in FIG. 12 of the applicant's '089 patent mentioned above.

In most designs, each of the four corners of a given wall is intended to be square. But the angles at one pair of diagonally opposite corners tend to become acute and the angles at the other pair of diagonally opposite corners tend to become obtuse in response to an external force having a component parallel to the plane of the wall. The wind can generate such a force on a first wall by blowing against a second wall that is connected at right angles to the first wall.

In the prior art, therefore, part of the time and labor required to construct an edifice of metal logs goes to the installation of X-bracing, which is bracing running crisscross between the two pairs of diagonally opposite corners of the several walls of the edifice.

In conventional practice, in order to prevent infiltration of air and water, it is also necessary to install at least exterior sheathing, and builders usually wish to install interior sheathing as well. The additional steps and materials required add to the time and cost of construction.

The drawbacks noted above have prevented metal-log construction from realizing its full potential.

OBJECTS AND SUMMARY OF THE INVENTION

An object of the invention is to improve further the construction methods and resulting buildings disclosed in the patents mentioned above and in other prior art. In particular, an object of the invention is to further simplify and speed up the construction of metal-log buildings while lowering their cost and improving their rigidity and resistance to horizontal loads generated by wind, earthquake, etc.

The invention attains these and other objects through a novel combination of elements. It employs at least first and second hollow metal logs each extending horizontally and arranged in adjacent parallel relation to form, or be part of, a wall or sloping roof. It further employs at least one rigidifying member that is U-shaped or J-shaped in cross section and made of a metallic, synthetic, cementitious or organic material. The rigidifying member has a first portion wrapping partway around the first log and a second portion comprising, in the U-shaped embodiment, substantially parallel, spaced-apart legs descending from opposite sides of the first portion at least to the second log to form interior and exterior sheathing. In the J-shaped embodiment, the rigidifying member comprises a single leg descending from the first portion at least to the second log to form exterior sheathing.

The sheathing formed by the legs, having a shape that is decoupled from the shape of the logs, will typically be substantially planar but can take any form the engineer or building designer wishes to give it. Additional sheathing is optional but by no means required.

The rigidifying member can also have in principle the shape of a P, though a P shape is harder to assemble with the logs. A J shape is suitable especially where sheathing is intended for only one side (normally the outer side) of the wall or roof. In order to shed rain, the U or J shape is inverted or otherwise suitably oriented when the rigidifying member is in place forming a part of a wall or sloping roof.

An adhesive material such as stucco, cement, gunite, glue, mud (adobe), or a combination of two or more thereof and/or a fastening means such as staples, rivets, screws, or a combination of two more thereof bonds or otherwise secures the rigidifying member to the metal logs, thereby forming a continuous structural ensemble resistant to parallel horizontal forces and obviating the X-bracing that is otherwise recommended. The rigidifying member can have a surface that is entirely smooth. Or, in order to bond better with the adhesive material, it can be or comprise a mesh, a sheet-like material formed with holes, or an expanded material. (The metal logs can also be formed with holes or otherwise to foster bonding with an adhesive material.)

The structure described above is repeated as necessary with the rigidifying members overlapping and being bonded or otherwise secured not only to the logs as described above but also to one another to form a complete wall or sloping roof and ultimately an entire edifice, with suitable provision for doors, windows, floors, chimneys, vents, electrical service, supply and waste plumbing, etc. The overlapping rigidifying members may give a completed wall the appearance of clapboard or stucco, depending on the amount, kind and distribution of any bonding material employed.

BRIEF DESCRIPTION OF THE DRAWINGS

A better understanding of the objects, features and advantages of the invention can be gained from the following detailed description of the preferred embodiments thereof, in conjunction with the appended figures of the drawings, wherein.

DETAILED DESCRIPTION OF PREFERRED EMBODIMENTS OF THE INVENTION

Figure 1:
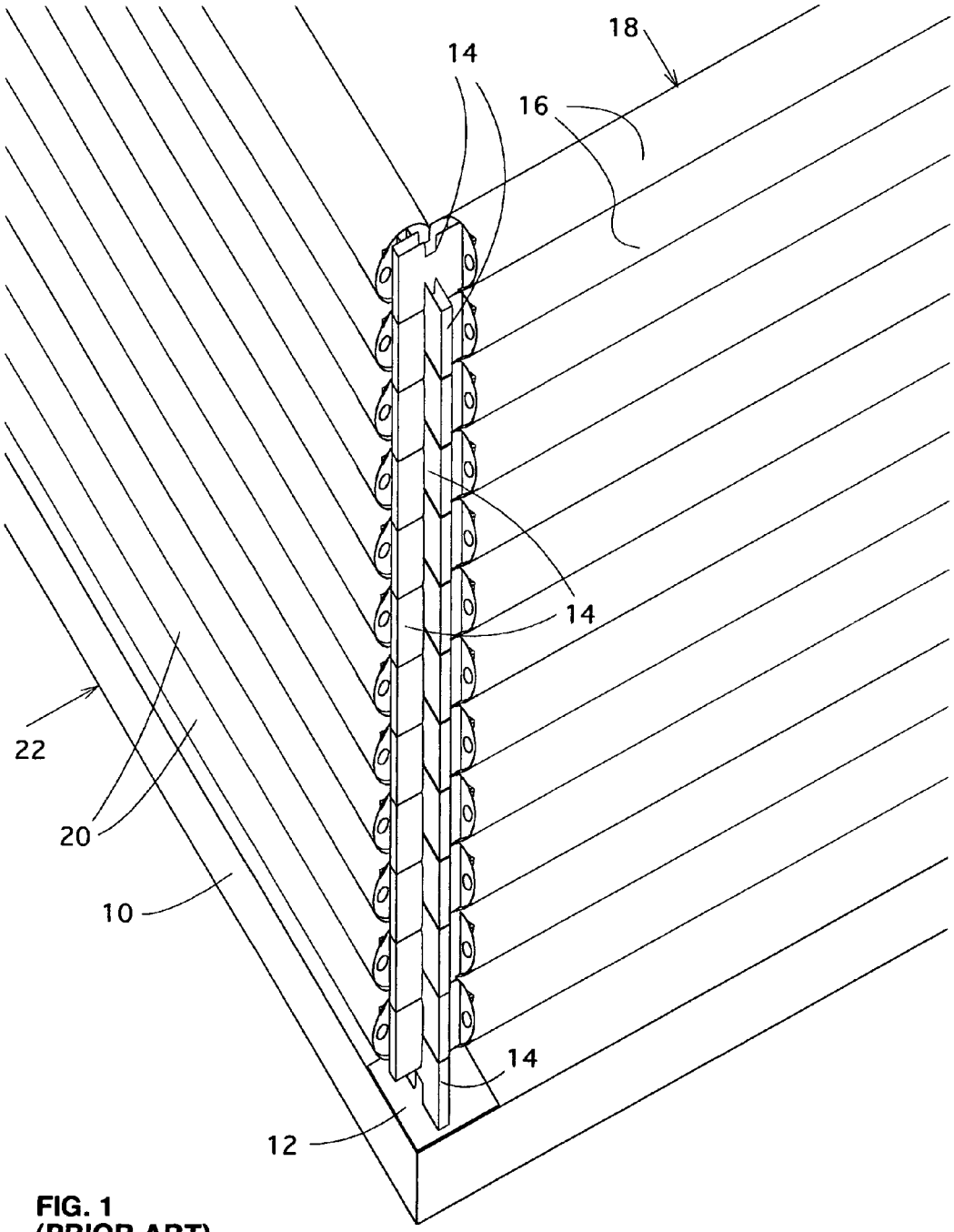
FIG. 1 (PRIOR ART)
FIG. 1 is a fragmentary perspective view of a corner of a conventional structure made of hollow metal logs, showing end connectors that fit within the logs, the end connectors being stacked one on top of another and the logs being supported by the end connectors, possibly though not necessarily in spaced-apart relation, to form two walls that intersect at a right angle.

FIG. 1 shows a conventional metal-log structure. A slab 10 supports an anchor plate 12 upon which are stacked end connectors 14. The end connectors 14 are alternately inserted into hollow metal logs 16 forming part of a first wall 18 and hollow metal logs 20 forming part of a second wall 22. The slab 10 normally rests upon the ground and can be made of poured concrete or another suitable foundation material. The anchor plate 12 can be made of steel and is embedded in or otherwise firmly attached to the slab 10. The lowermost end connector 14 is secured to the anchor plate 12. Higher end connectors are stacked alternately at right angles to one another and inserted alternately into respective ends of logs 16 and 20.

Figure 12:
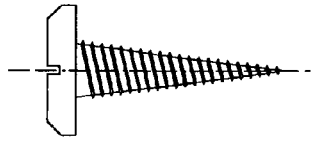

It is also possible to employ a stanchion (not shown) secured to the slab 10 with or without an anchor plate 12 and formed with vertical grooves for receiving the ends of the logs, as disclosed for example in FIG. 12 of applicant's '089 patent mentioned above.

In FIG. 1, a wind blowing from the left against the wall 22 will tend to tilt the stack of end connectors 14 to the right. (It will also tend to tilt to the right the corresponding stacks of end connectors, not shown, at the far ends of the walls 18 and 22.) The upper left corner of the wall 18 will tend to move closer to the lower right corner of the wall (not shown), and the upper right corner (not shown) of the wall 18 will tend to move farther away from the lower left corner. The same applies to the wall, not shown, opposite the wall 18. The converse is also true: a wind blowing against the wall 18 or the wall opposite the wall 18 will tend to distort the wall 22 and the wall opposite the wall 22.

To counter this tendency, it is highly recommended in conventional practice to add X-bracing (not shown) running from upper left to lower right and from lower left to upper right of each wall.

Figure 2:
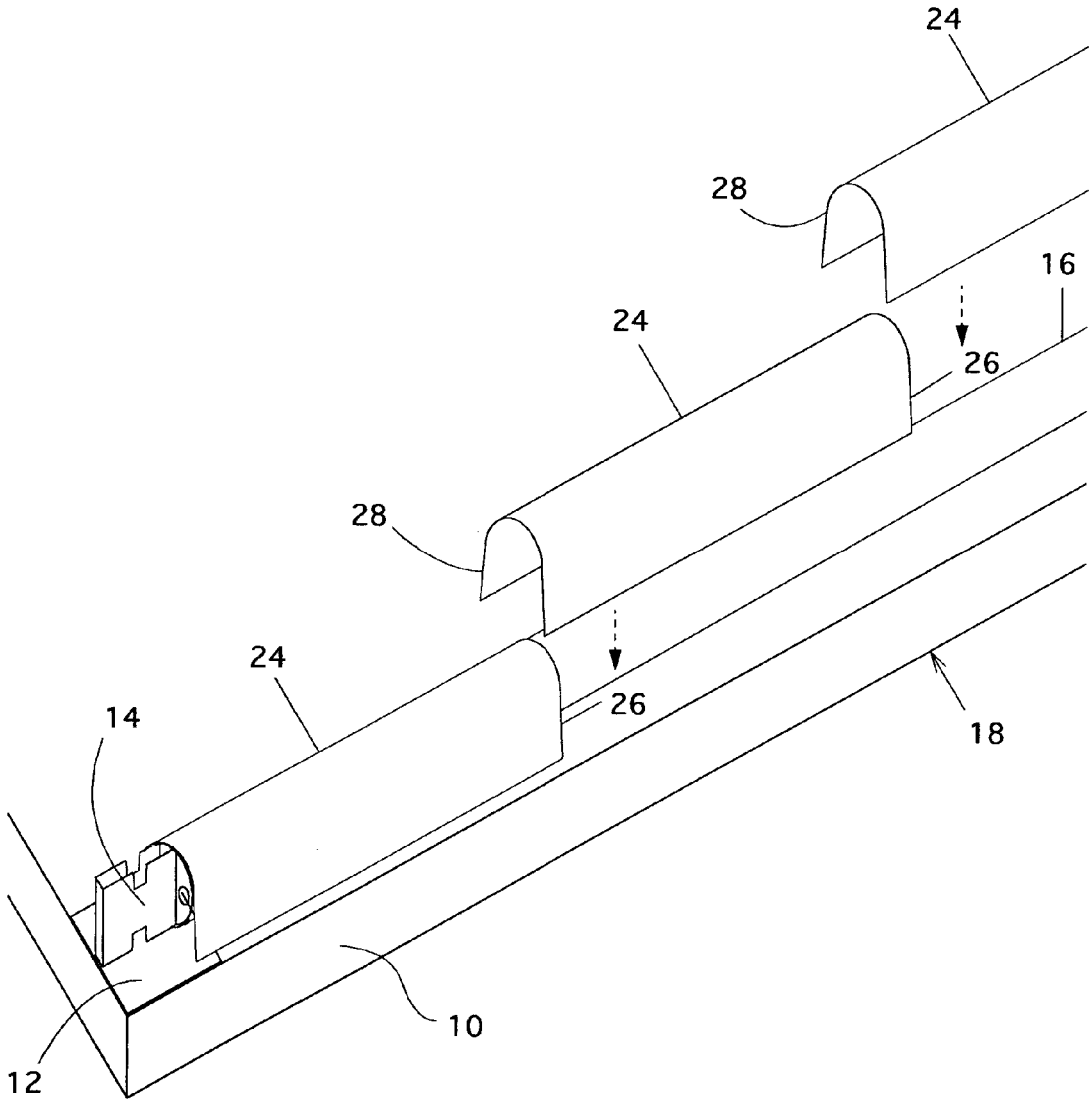
FIGS. 2-4 are perspective views corresponding to FIG. 1 and together showing successive stages in the construction of an edifice including U-shaped rigidifying members in accordance with the invention.
Figure 3:
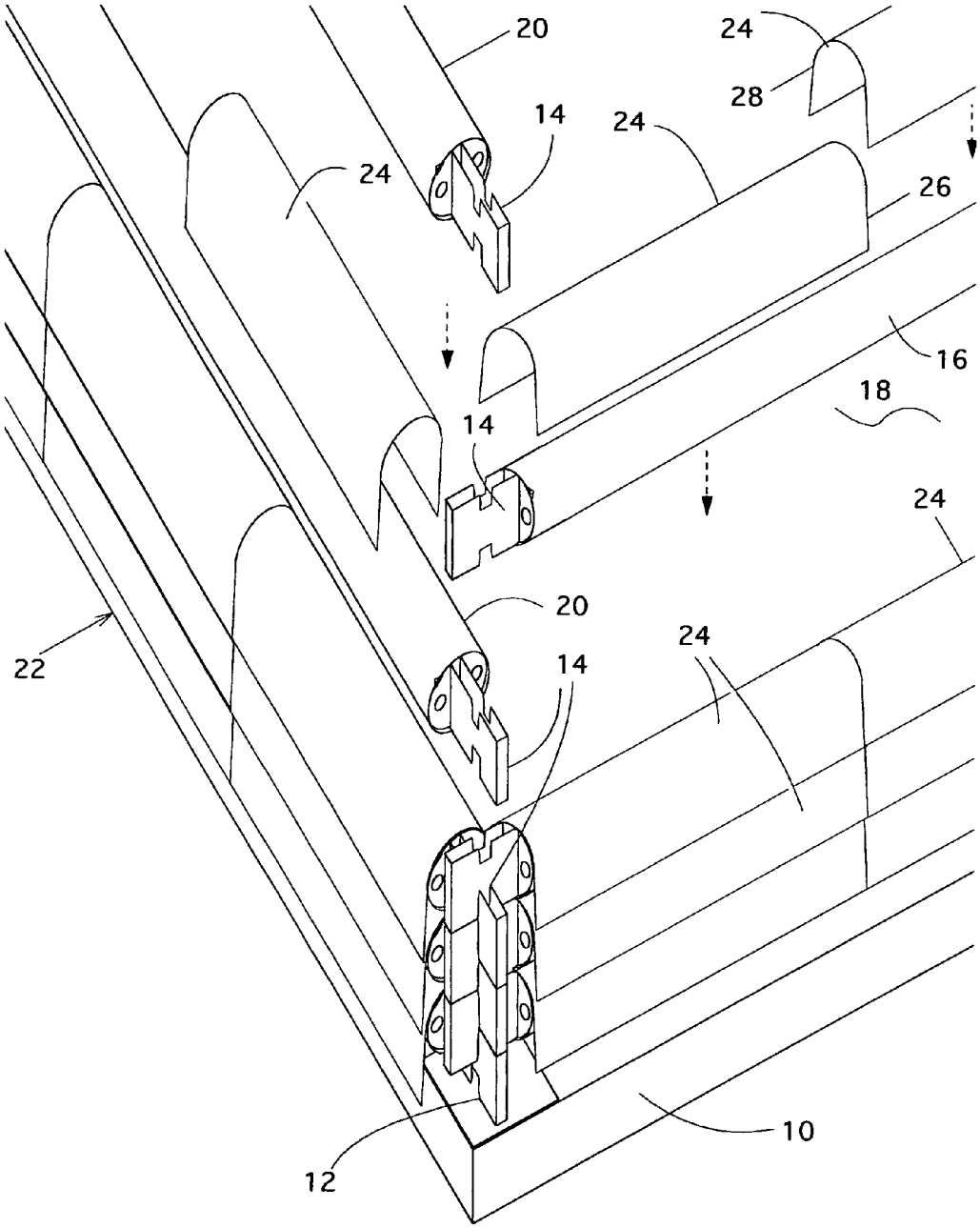
Figure 4:
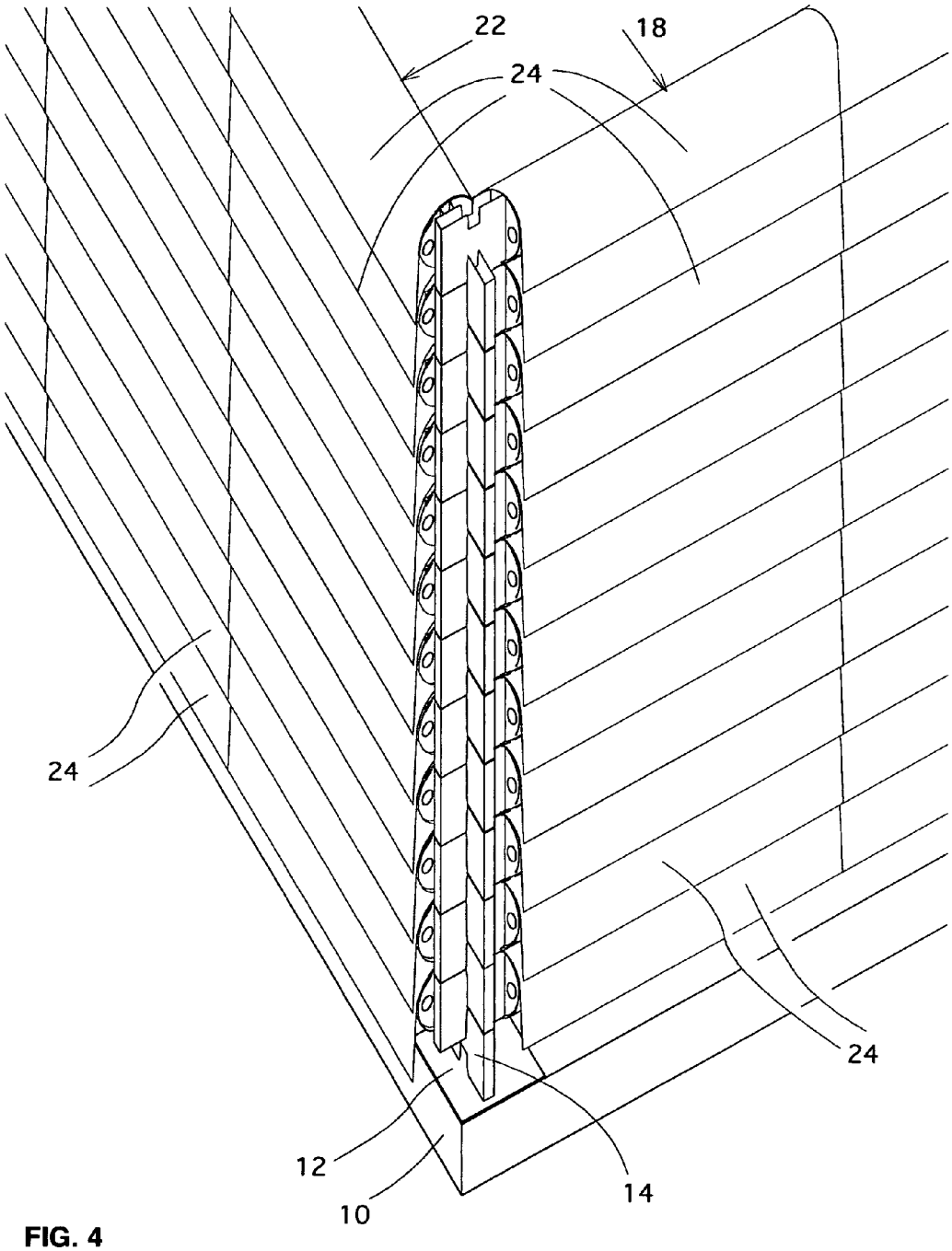

FIGS. 2-4 show successive stages in the construction of an edifice in accordance with one embodiment of the invention. A slab 10 supports an anchor plate 12, to which an end connector 14 is attached, as in FIG. 1. The end connectors 14 support the illustrated ends of logs 16 and 20. Successive end connectors 14 are stacked as described above. And, of course, end connectors, stanchions, or other suitable means (not shown) likewise support the opposite ends of the logs. Rigidifying members 24, which are U-shaped in cross section and made of metallic, synthetic, or organic material, "ride" on the hollow metal logs 16 and 20. The logs and rigidifying members are successively dropped into place, as indicated by downward-pointing arrows.

When the U-shaped members are installed, an edge 26 of one U-shaped member 24 abuts an edge 28 of a horizontally adjacent U-shaped member 24. The seam between the edges 26 and 28 can be caulked, but at least in warm climates caulking may be unnecessary if the U-shaped members are offset from one course to the next as in a conventional brick wall. Alternatively, the rigidifying members may be laterally spaced apart, thereby reducing the cost of materials while still providing adequate rigidity. Of course, if the rigidifying members are laterally spaced apart, separate sheathing is required, or at least the space between logs must be caulked.

FIG. 2 shows a log 16 in place, a U-shaped member 24 riding the log 16, and additional U-shaped members 24 about to be installed on the log 16.

FIG. 3 shows three courses of logs 16 and 20 of the walls 18 and 22 and U-shaped members 24 riding the logs. It further shows additional logs 16 and 20 and U-shaped members 24 about to be installed.

FIG. 4 shows the wall upon completion of the process described above. Corner finishing pieces (not shown) are not required but can be added if desired.

Figure 5:
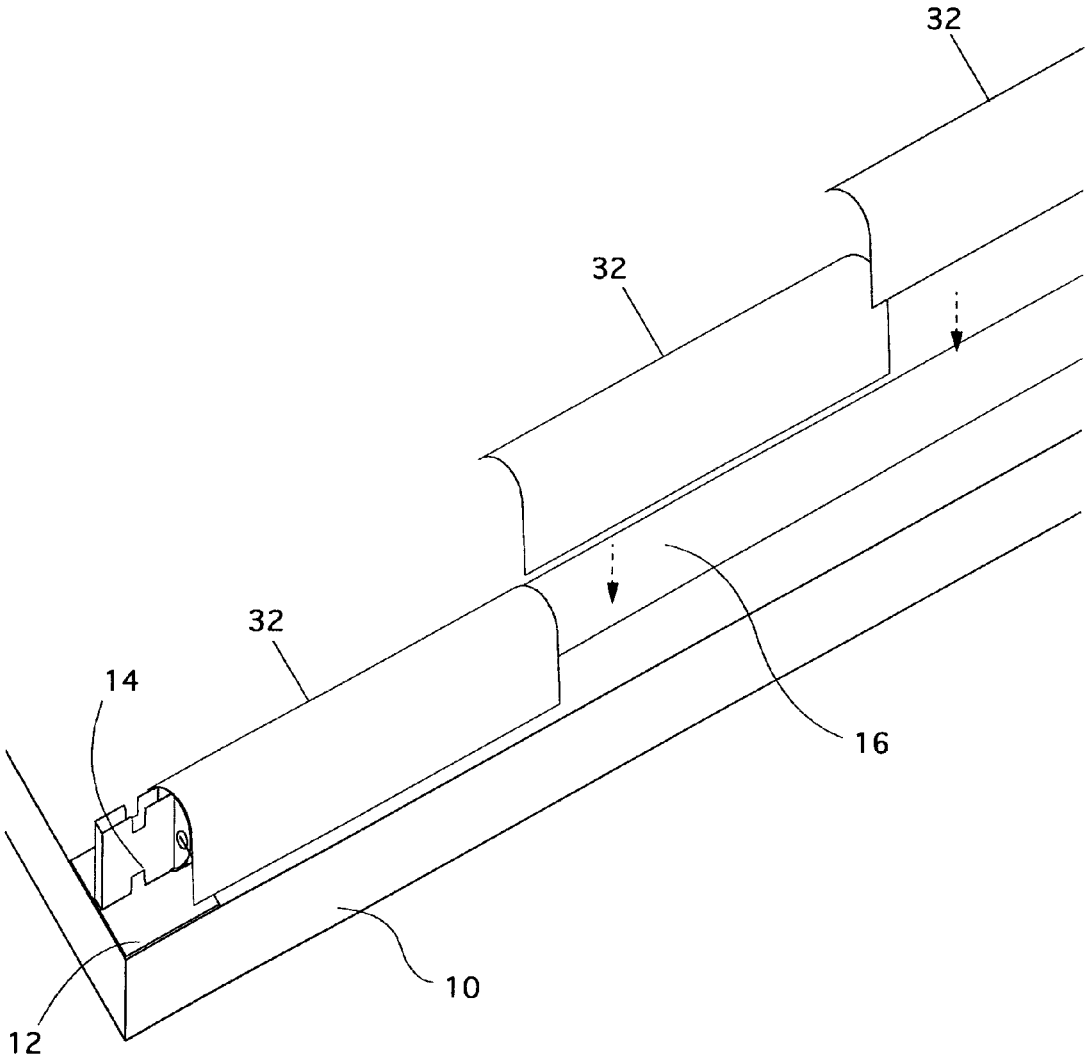
FIGS. 5-7 are perspective views corresponding to FIGS. 2-4 and together showing successive stages in the construction of an edifice including J-shaped rigidifying members in accordance with the invention.
Figure 6:
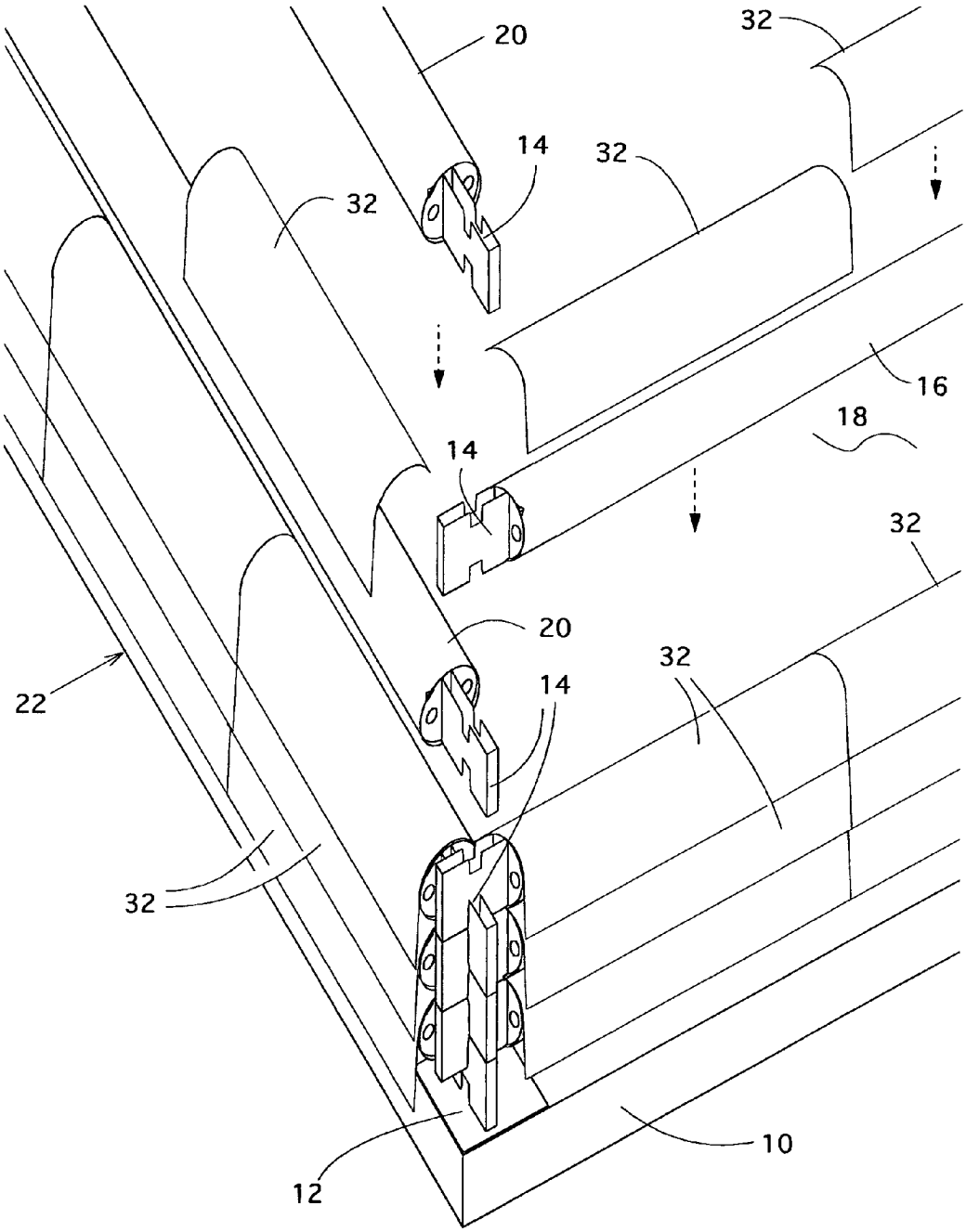
Figure 7:
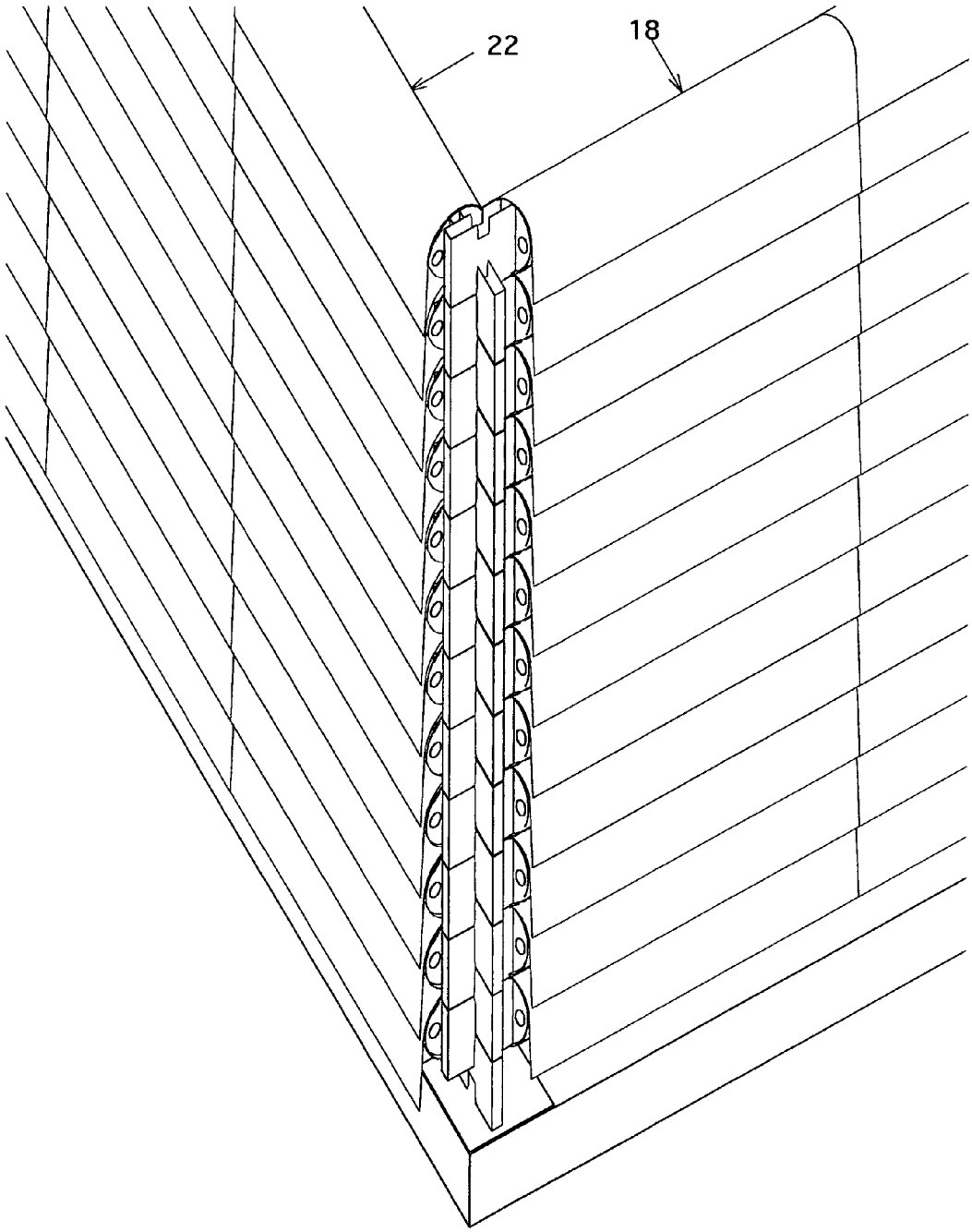

FIGS. 5-7 show successive stages in the construction of an edifice in accordance with another embodiment of the invention. FIG. 5 shows J-shaped members 32, also made of metallic, synthetic, or organic material. The members 32 are shown riding, or about to ride, a lowermost log 16. FIGS. 6 and 7 show a continuation of the process.

The members 32 have a curved first portion that wraps part way around a log, for example from a quarter of the way to halfway, and a single leg descending from the curved portion of the J. The descending leg will normally be on the outside of the edifice. The inside can be separately sheathed or left unsheathed, as may suit the purposes of the architect or designer. The J-shaped members 32 are secured to the logs 16 and to each other and rigidify the resulting edifice.

The logs of all of the walls of an edifice, including both of the walls 18 and 22, are normally provided with the U-shaped rigidifying members 24 as in FIGS. 2-4 or the J-shaped rigidifying members 32 as in FIGS. 5-7. But it is within the scope of the invention to add rigidifying members 24 or 32 to the logs of fewer than all the walls, as in FIGS. 8 and 9, or to only part of a wall, of the edifice.

Figure 8:
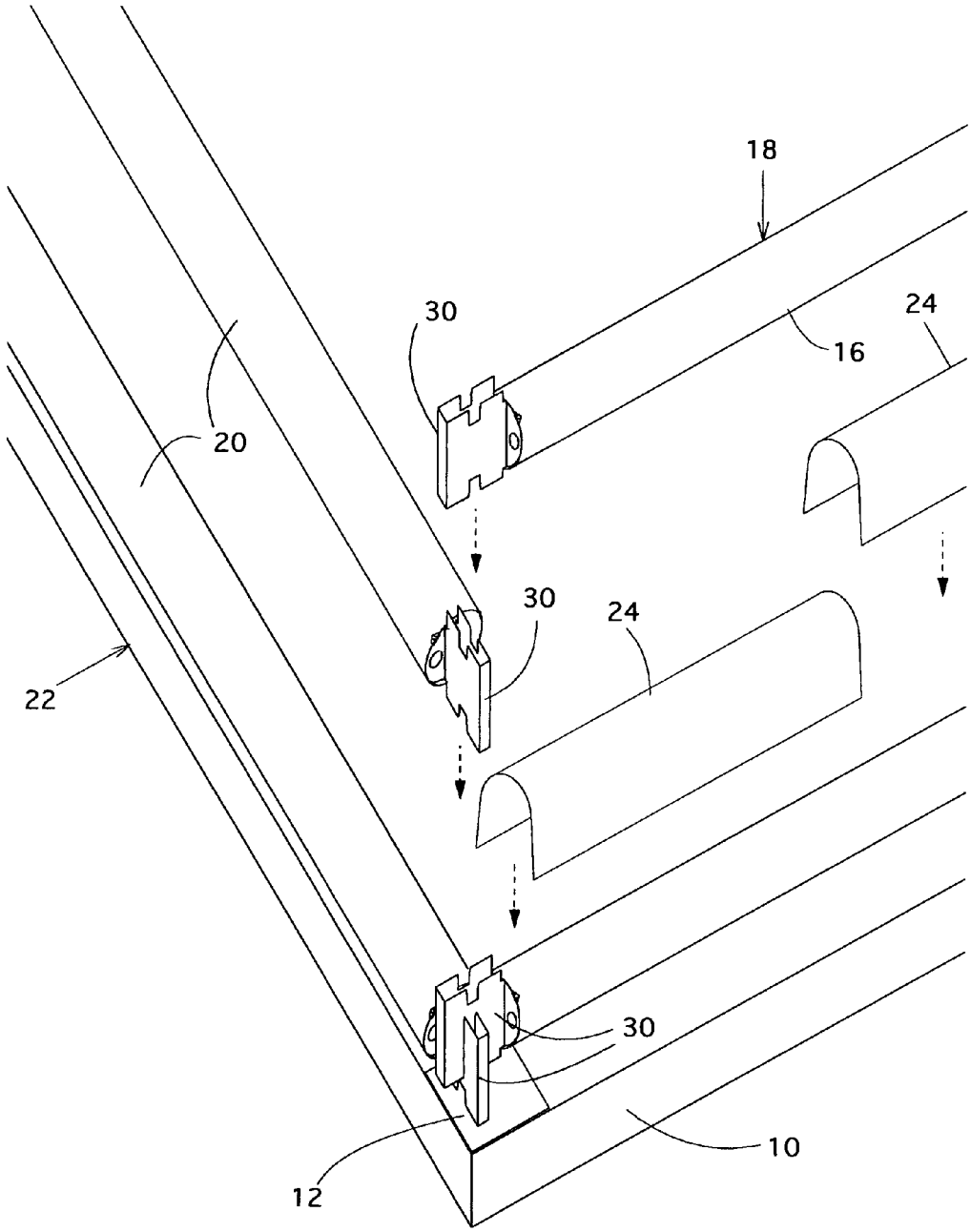
FIGS. 8 and 9 are perspective views showing U-shaped (FIG. 8) and J-shaped (FIG. 9) rigidifying members riding logs supported by a different type of end connector and employed in only one of a pair of adjacent walls.
Figure 9:
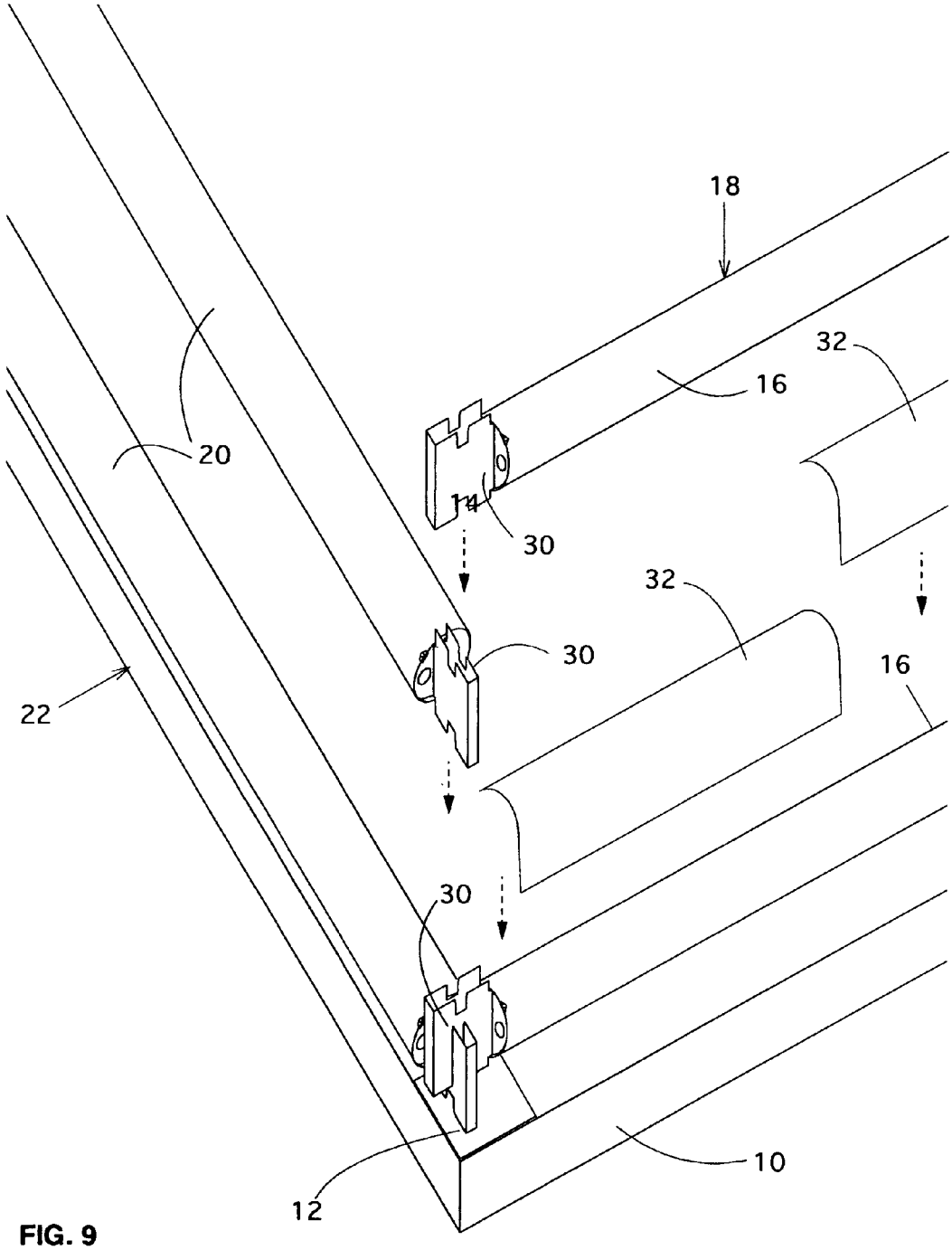
Figure 21:
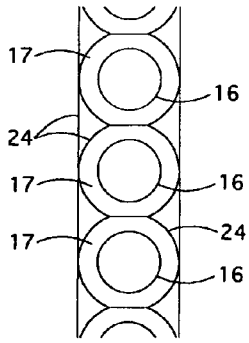
FIG. 21 is a schematic end elevation showing insulating sleeves wrapped around the logs and interposed in accordance with the invention between the logs and the U-shaped rigidifying members.

FIG. 8 shows the U-shaped rigidifying members 24 in use with connectors 30 that are taller than the connectors 24 and leave a space, or a wider space, between adjacent superposed logs. This enables the insertion of insulation 17 in the form of a sleeve around the logs 16 and between them and the rigidifying members 24, as shown in FIG. 21, thereby insulating the wall or roof and enhancing the suitability of the structure for use in cold or extremely warm climates. (FIG. 21 is schematic and does not show the thickness of the material forming the rigidifying members 24. It does, however, show as a feature of the invention that the U-shaped members can be squared off at the base of the U.) FIG. 9 shows connectors 30 in combination with J-shaped rigidifying members 32. In FIGS. 8 and 9, the descending legs of the rigidifying members are appropriately lengthened as compared to the embodiments of the rigidifying members employed with end connectors having when installed a shorter vertical or sloping dimension. Walls and sloping roofs having J-shaped rigidifying members can be insulated by applying the principle illustrated in FIG. 21.

In all embodiments of the invention, the U-shaped or J-shaped members are inverted or otherwise suitably oriented so that they shed rain when incorporated into a wall or sloping roof.

Figure 10:
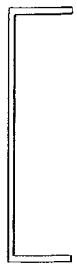
FIGS. 10-16 are schematic and fragmentary views illustrating features of alternative embodiments of the invention.
Figure 11:
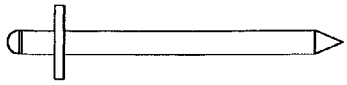
Figure 13:
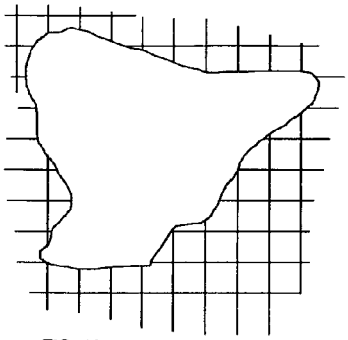
Figure 14:
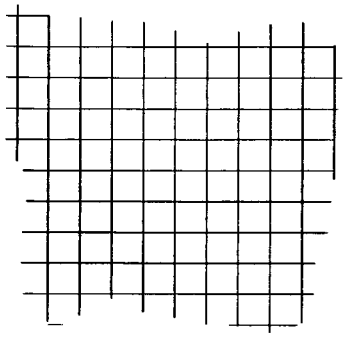
Figure 15:
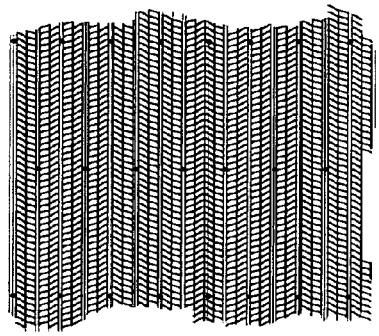
Figure 16:
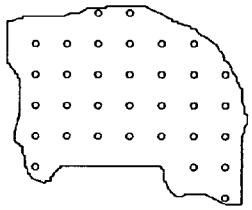

Staples (FIG. 10), rivets (FIG. 11), screws (FIG. 12) or an adhesive (as in fragmentary FIG. 13) such as stucco, cement, gunite, glue, dried mud (adobe), or a combination of two or more thereof can be used to secure the rigidifying members to the logs and to one another. A segment (which can be the entirety or less than the entirety) of the rigidifying members can be formed as a mesh (as in fragmentary FIG. 14), an expanded metal (as in fragmentary FIG. 15), a perforated sheet (as in fragmentary FIG. 16), etc.

Figure 17:
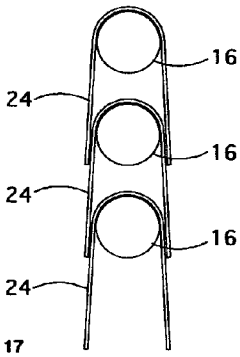
FIGS. 17-19 are end elevations illustrating alternative embodiments of a U-shaped rigidifying member in accordance with the invention.
Figure 18:
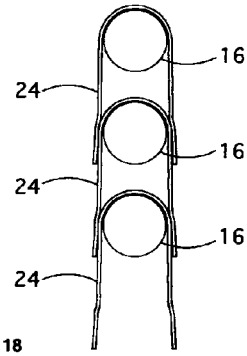
Figure 19:
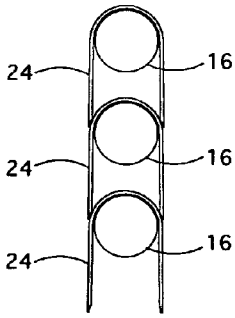
Figure 20:
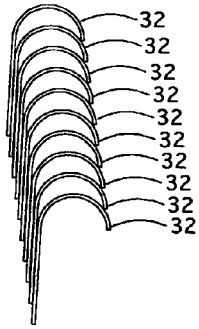
FIG. 20 is an end elevation showing a nesting feature of a J-shaped rigidifying member in accordance with the invention.

The rigidifying members may also be constructed so that they can be fully or partly nested or stacked for compact and economical shipment. To that end, the U-shaped members may flare out slightly towards the open end of the U, as in FIG. 17, either because they are made that way or because they are flexible enough to flare out slightly when installed in a wall or sloping roof as described above or when nested with other U-shaped members. Alternatively, they can have a flange at the open end, as in FIG. 18. Or they can be constructed as in FIG. 19 without a flare or flange, in which case they can be nested for shipment by reversing every other member. In the embodiment of FIG. 19, the ends of the legs can be beveled for better attachment to the rigidifying member next below. The J-shaped elements are easily nested for compact and economical shipment, as in FIG. 20. They can be nested even more tightly if they wrap only a quarter of the way around the logs.

The present invention is applicable irrespective of whether or not the metal logs are wrapped with insulation, and therefore irrespective of the spacing between the logs. The descending leg of the J or spaced-apart descending legs of the U can have any suitable length in the vertical or sloping direction. When incorporated into a wall to ride a given log, the leg of the J descends on the outer side, or the legs of the U respectively descend on either side, of that log and are substantially tangent to one or more logs below. In an assembled wall or sloping roof, the lower ends of any such rigidifying members, except the lowest member, overlap one or more such members below and are attached to one another and to the logs by any suitable means, as described above.

The overlapping rigidifying members create continuous surfaces on one or both sides of the wall or roof, depending on whether the rigidifying members are J-shaped or U-shaped. They can be made of any suitable material, including polyethylene, polyvinyl chloride, aluminum, galvanized steel, and flax or hemp impregnated with a stiffener. Depending on the type of sheet used to form the rigidifying members—a smooth material with no openings (FIGS. 2-7), a mesh (FIG. 14), an expanded material (FIG. 15), a sheet-like material formed with holes (FIG. 16), etc.—they can serve either as cladding or as support for stucco or similar finishing materials. Thus, while the invention preserves the option of adding separate sheathing or, for example, a stucco finish, no further sheathing or finishing is required.

It may be desirable in some cases to form the U-shaped rigidifying members of different materials on opposite sides of a wall or roof. For example, a first material having good weathering properties may be used on the part of a U-shaped rigidifying member that is exposed to the weather, and a second, different material having a desired color or texture may be used on the part of the rigidifying member that is seen from the inside of a building. The two materials are rigidly joined at their midline, where they wrap a log.

For maximum rigidity, rigidifying members ride every log and secure it to the next adjacent log below and to a rigidifying member that rides the adjacent log. It is, however, less expensive and within the scope of the invention to skip some of the logs and deploy rigidifying members on every other log, every third log, etc. If every other log is skipped, the descending leg of the J or the descending spaced-apart legs of the U are long enough in the vertical or sloping direction to be tangent and secured to the next two lower logs and to the rigidifying member that rides the second of the two lower logs. If two successive logs are skipped, then the descending leg of the J-shaped members or the spaced-apart descending legs of the U-shaped members are long enough in the vertical or sloping direction to be tangent to the next three logs below and to the rigidifying member that rides the third of the three lower logs, etc.

That is, in one embodiment (not shown), at least first through fifth log-shaped members are arranged sequentially in adjacent, slightly spaced-apart relation. At least first and second rigidifying members are employed. A first portion of the first rigidifying member wraps at least partly around the first log-shaped member. A second portion of the first rigidifying member lies substantially in a plane, extends from the first portion of the first rigidifying member at least to the third log-shaped member, and overlaps the second log-shaped member and the second rigidifying member.

A first portion of the second rigidifying member wraps at least partly around the third log-shaped member, and a second portion of the second rigidifying member lies substantially in the plane mentioned above, extends from the first portion of the second rigidifying member at least to the fifth log-shaped member, and overlaps the fourth log-shaped member. Means is provided securing the first rigidifying member to each of the first through third log-shaped members, the second rigidifying member to each of the third through fifth log-shaped members, and the first and second rigidifying members to each other to form a continuous structural ensemble resistant to an external force having a horizontal component parallel to said plane.

While normally a given construction project will employ only U-shaped or only J-shaped rigidifying members, it is within the scope of the invention to employ both types of rigidifying members in the same edifice and even in the same wall.

The purpose of the rigidifying members is twofold: the most important is that it makes a wall of logs behave structurally as a unit well adapted to absorb parallel horizontal forces. That is, instead of working independently of one another, as in the prior art, the logs collaborate with one another as a continuous structural ensemble. Consequently, walls and sloping roofs constructed in accordance with the invention do not require the diagonal bracing otherwise recommended.

Second, the overlapping rigidifying members create continuous surfaces on one or both sides of the wall or roof, depending on whether the rigidifying members are J-shaped or U-shaped, as described above. As also described above, the rigidifying members can serve either as cladding or as support for stucco or similar finishing materials. Thus, while the invention preserves the option of adding separate sheathing or, for example, a stucco finish, no further sheathing or finishing is required.

The savings in time and materials made possible by the omission of bracing and sheathing or other finishing, though surprising and not predictable, are measurable and substantial.

The invention provides a novel and highly effective structure and method accomplishing the stated objects and others. The embodiments of the invention disclosed herein are the ones preferred, but upon reading this disclosure, people skilled in the art may readily envision others. The invention encompasses all structures and methods that fall within the scope of the appended claims.

The invention claimed is:

1. In combination, at least first and second log-shaped members arranged in adjacent relation to form, or be part of, a wall or sloping roof and at least a first rigidifying member having a first portion wrapping at least partly around said first log-shaped member and a second portion extending from said first portion at least to said second log-shaped member to form a surface, said surface having a shape that need not conform to respective surfaces of said first and second log-shaped members, and means securing said first rigidifying member to each of said log-shaped members further comprising at least a third log-shaped member arranged in adjacent parallel relation to said second log-shaped member and forming, or being a part of, said wall or sloping roof and at least a second rigidifying member having a first portion wrapping at least partly around said second log-shaped member and a second portion extending from said first portion of said second rigidifying member at least to said third log-shaped member to form a second surface, said second surface having a shape that need not conform to respective surfaces of said second and third log-shaped members, and means securing said first and second rigidifying members to each of said log-shaped members and to each other.

2. The combination of claim 1 wherein said surface formed by said second portion is planar.

3. The combination of claim 1 wherein said securing means comprises an adhesive material and said rigidifying member comprises a segment constructed to receive said adhesive material.

4. The combination of claim 3 wherein said segment is selected from the group consisting of a smooth material, a mesh, a sheet-like material formed with holes, and/or an expanded material, and said adhesive material is selected from the group consisting of stucco, cement, gunite, glue, and dried mud (adobe).

5. The combination of claim 3 wherein said segment is substantially coextensive with said rigidifying member.

6. The combination of claim 1 wherein said first rigidifying member comprises a material selected from the group consisting of a metallic material, a synthetic material, and an organic material.

7. The combination of claim 1 wherein said second portion comprises first and second legs respectively extending from opposite sides of said first portion at least to said second log-shaped member to form a surface on either side of said first and second log-shaped members, whereby each of said surfaces has a shape that need not conform to respective surfaces on either side of said first and second log-shaped members.

8. The combination of claim 7 wherein said rigidifying member is substantially U-shaped and said first and second legs are substantially planar.

9. The combination of claim 8 forming a wall or a part of a wall wherein the log-shaped members are superposed and the U shapes are inverted.

10. The combination of claim 1 wherein said rigidifying member is shaped so that two or more of such members can be nested for economical transportation.

11. The combination of claim 1 comprising thermal insulation wrapped around each of said log-shaped members and interposed between said log-shaped members and said rigidifying members, thereby insulating said wall or sloping roof.

12. In combination, first and second metal logs arranged in adjacent relation to form, or be part of, a wall or sloping roof and a rigidifying member having a first portion wrapping substantially halfway around said first log and a second portion comprising first and second legs respectively extending in substantially parallel relation from opposite sides of said first portion at least to said second log to form a substantially planar surface on either side of said first and second logs, each of said surfaces forming or being adapted to support sheathing for said wall or roof further comprising at least a third log-shaped member arranged in adjacent parallel relation to said second log-shaped member and forming, or being a part of, said wall or sloping roof and at least a second rigidifying member having a first portion wrapping at least partly around said second log-shaped member and a second portion extending from said first portion of said second rigidifying member at least to said third log-shaped member to form a second surface, said second surface having a shape that need not conform to respective surfaces of said second and third log-shaped members, and means securing said first and second rigidifying members to each of said log-shaped members and to each other.

13. A building method comprising the steps of arranging first and second log-shaped members in adjacent relation to form, or be part of, a wall or sloping roof, providing a rigidifying member having a first portion and a second portion, wrapping said first portion at least partly around said first log-shaped member, extending said second portion from said first portion at least to said second log-shaped member to form a surface that does not conform to respective surfaces of said first and second log-shaped members, and attaching said rigidifying member to said log-shaped members to form a continuous structural ensemble resistant to parallel horizontal forces further comprising arranging at least a third log-shaped member in adjacent parallel relation to said second log-shaped member to form, or being a part of, said wall or sloping roof and at least a second rigidifying member having a first portion wrapping at least partly around said second log-shaped member and a second portion extending from said first portion of said second rigidifying member at least to said third log-shaped member to form a second surface, said second surface having a shape that need not conform to respective surfaces of said second and third log-shaped members, and securing said first and second rigidifying members to each of said log-shaped members and to each other.

14. A method according to claim 13 comprising the step of employing as said rigidifying member a material selected from the group consisting of polyethylene, polyvinyl chloride, aluminum, galvanized steel, and a fiber impregnated with a stiffener.

15. A method according to claim 13 comprising the step of selecting said fiber from the group consisting of hemp, and flax.

* * * * *